US006449976B1

(12) United States Patent
Chai et al.

(10) Patent No.: US 6,449,976 B1
(45) Date of Patent: Sep. 17, 2002

(54) HORIZONTAL FREEZER WITH DRAWERS

(75) Inventors: Yongsen Chai, Qingdao (CN); Jian Ma, Qingdao (CN); Biao Li, Qingdao (CN); Kegang Huang, Qingdao (CN)

(73) Assignees: Haier Group Corporation, Qingdao (CN); Qingdai Haier Icebox Co., Ltd., Qingdao (CN)

( * ) Notice: Subject to any disclaimer, the term of this patent is extended or adjusted under 35 U.S.C. 154(b) by 0 days.

(21) Appl. No.: 09/881,094

(22) Filed: Jun. 15, 2001

Related U.S. Application Data

(63) Continuation of application No. PCT/CN01/00550, filed on Apr. 9, 2001.

(51) Int. Cl.[7] ..... F25D 25/02
(52) U.S. Cl. ..... 62/382; 62/441
(58) Field of Search ..... 62/382, 440, 441, 62/443, 252, 254, 257; 311/116; 312/401, 409

(56) References Cited

U.S. PATENT DOCUMENTS 2,554,290 A * 5/1951 Becker ..... 62/116
2,961,851 A * 11/1960 Ehrenfreund ..... 62/448
4,759,193 A * 7/1988 Dehring ..... 62/258
4,951,481 A * 8/1990 Negishi ..... 62/406
5,735,131 A * 4/1998 Lambright, Jr. et al. ..... 62/99

FOREIGN PATENT DOCUMENTS

| | | |
|---|---|---|
| CN | ZL92236971.2 | 2/1994 |
| JP | 7-243746 | 9/1995 |
| JP | 10-141834 | 5/1998 |

* cited by examiner

*Primary Examiner*—William C. Doerrler
*Assistant Examiner*—Melvin Jones
(74) *Attorney, Agent, or Firm*—Burns, Doane, Swecker & Mathis, L.L.P.

(57) ABSTRACT

A horizontal freezer comprising a housing including an upper freezing chamber and a freezing chamber, the upper freezing chamber and lower freezing chamber being separated by a plate, the upper freezing chamber having a top entrance and the lower freezing chamber having a side entrance; a cover connected to the top of the housing for closing the top entrance of the upper freezing chamber; a drawer being mounted in the lower freezing chamber by means of a sliding support assembly; an evaporator, at least part of which is embedded in said housing, the housing includes an upper front panel, back panel and two opposite side panels, with the upper front panel connected to the two opposite side panels. The sliding support assembly includes an inner sliding support and an outer sliding support.

15 Claims, 5 Drawing Sheets

HORIZONTAL FREEZER WITH DRAWERS

This application is a continuation of International Application No. PCT/CN01/00550, filed on Apr. 9. 2001, which International Application has not yet been published by the International Bureau.

FIELD OF THE INVENTION

This invention relates to a domestic freezer, and more particularly to a horizontal freezer with drawers therein.

BACKGROUND OF THE INVENTION

Most of horizontal freezers known in the art comprise only one freezing chamber which defines a top entrance. The freezing chamber of this kind of horizontal freezer has a great depth and the lower frozen food is not accessible without removing the upper ones, causing its use cumbersome and part of cooling air lost. In addition, the temperature in the freezing chamber is uniformly distributed and different kinds of food can not be stored according to their desired freezing temperatures. To solve above problems, some manufacturers attempt to develop a horizontal freezer having a drawer therein. The Chinese Utility Model ZL9223697.2 discloses this type of freezer, comprising upper part and lower part, each part having one or more freezing chambers, the upper freezing chamber is provided with top entrance and closed with a movable cover; the lower freezing chamber is provided with a drawer therein. The compressor of the freezer is provided in the lower part adjacent to the side wall so as to optimize the use of space. Since ZL9223697.2 fails to further disclose the structure of the freezer, especially the structure of the housing, the position of evaporator and the structure of the drawer sliding means, not to mention the optimum structure, so there is a need to improve for its commercial use. In the housing of conventional freezer, although back panel is a separate element, the front panel is integrally formed with the two opposite side panels. As drawer entrance should be formed in the lower part of the front panel, this adds the difficulties to the manufacturing of the housing, the high cost to the mold, complications to the assembling of the freezer as well as the difficulties to the processing of the edge of the drawer entrance, and hence makes productivity low. In addition, the drawer is generally mounted on the housing by using a slide support assembly which includes an inner sliding support and an outer sliding support and the outer sliding support comprises two guiding rails directly secured to the opposite sides of the housing. These two rails tend to deform, resulting in cumbersome positioning and high sliding resistance. In addition, it is difficult to manufacture them in mass productivity.

SUMMARY OF THE INVENTION

An object of the present invention is to overcome above drawbacks of the prior art by providing a horizontal freezer with drawer(s), which defines a novel housing structure and is easy to manufacture, meanwhile gives the different freezing chambers with properly sized space.

Another object of the present invention is to provide a horizontal freezer with drawer(s), which provides with a stable drawer sliding structure in the lower freezing chamber to improve the assembling and the supporting of the drawers and hence increase the productivity.

In an aspect of the invention, there is provided a horizontal freezer with drawer(s), comprising: a housing including an upper freezing chamber and at least one lower freezing chamber, the upper and lower chamber being separated by a plate, the upper freezing chamber having a top entrance and the lower freezing chamber having a side entrance; an cover connected to the top of the housing for closing the top entrance of the upper freezing chamber; at least one drawer, said drawer being mounted in the lower freezing chamber by means of a sliding support assembly; an evaporator, at least part of which is embedded in said housing; the outer shell of the housing comprises an upper front panel pre-formed separately, a back panel and two opposite side panels, wherein the upper front panel connected to the two opposite side panels. According to the invention, the height of the upper panel is less than that of the opposite side panels and the top edge of the upper front panel is aligned with the top edge of the opposite side panels during assembling.

In above technical solution, in order to form the drawer entrance in the lower part of the housing, the housing, which was integrally formed in the prior art, is now divided into a front panel and two opposite side panels, they are separated when pre-formed. It is noted that the height of the upper front panel is less than that of the two opposite side panels, and the top edge of the front panel is aligned with the top edge of the two side panels during assembling and they are connected each other by conventional means, therefore having the benefit of assembling and manufacturing cost as well.

In another aspect of the invention, there is provided a horizontal freezer having drawer(s) therein, wherein the drawer sliding support assembly includes an inner sliding support and an outer sliding support, the outer sliding support having two guiding rails extending longitudinally along the opposite sides of the housing and a front crossing bar and a rear crossing bar connected therebetween, with the front crossing bar secured to said plate. According to further structural feature of the invention, the rear crossing bar secured to the rear wall of the internal shell of the lower freezing chamber of the housing.

Thus the drawer sliding support structure is improved. Unlike that the two rails directly secured to the two sides of the housing in the prior art, the outer sliding support of the sliding support assembly of the invention defines a frame structure and is secured to the plate and the rear wall of the internal shell of the housing by the front and rear crossing bars respectively, thus ensuring accurate fit between the inner sliding support and the outer sliding support.

According to further structural features of the invention, the evaporator in the housing is divided into a coiled pipe section and a planar-wound pipe section with the coiled pipe section embedded in the wall of the housing and the planar-wound pipe section exposed in the upper part of the lower freezing chamber. The coiled pipe section is connected with the planar-wound pipe section by a connector in the lower freezing chamber.

In as much as the evaporator consists of the coiled pipe section in the upper freezing chamber and the planar-wound pipe section in the lower freezer chamber, the coiled pipe is wound and placed into the outer wall of the internal shell before filling the foaming material into the housing (i.e. housing forming) and the planar-wound pipe is connected to the coiled pipe by a connector in the lower freezing chamber after housing forming and thus the coiled pipe section and the planar-wound pipe section can be handled separately. By way of this, the present invention has overcome the following drawback, that is, in the prior art, the section of evaporator in the upper freezing chamber and the one in the lower freezing chamber are generally connected each other by welding before assembling, and thus bring about some difficulties during assembling of the housing, especially foaming of the housing. In addition, a portion for connecting these two section by welding in the lower freezing chamber has a large size and is difficult to handle, thus the quality of welding is not guaranteed.

An embodiment of the invention will be described with reference to the drawings

DETAILED DESCRIPTION OF PREFERRED EMBODIMENT

Figure 1:
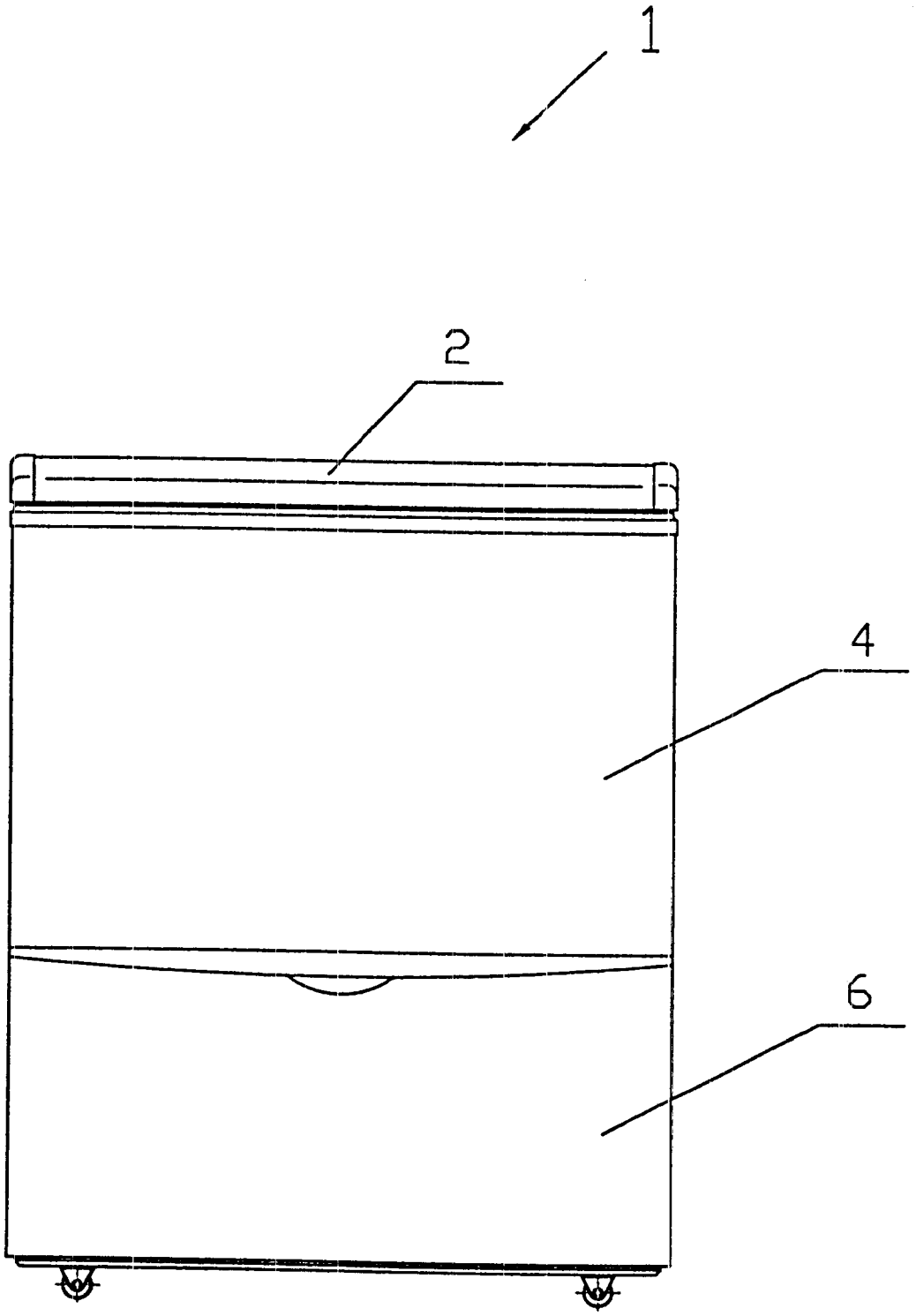
FIG. 1 is a front view of a horizontal freezer with drawers therein according to the invention.
Figure 2:
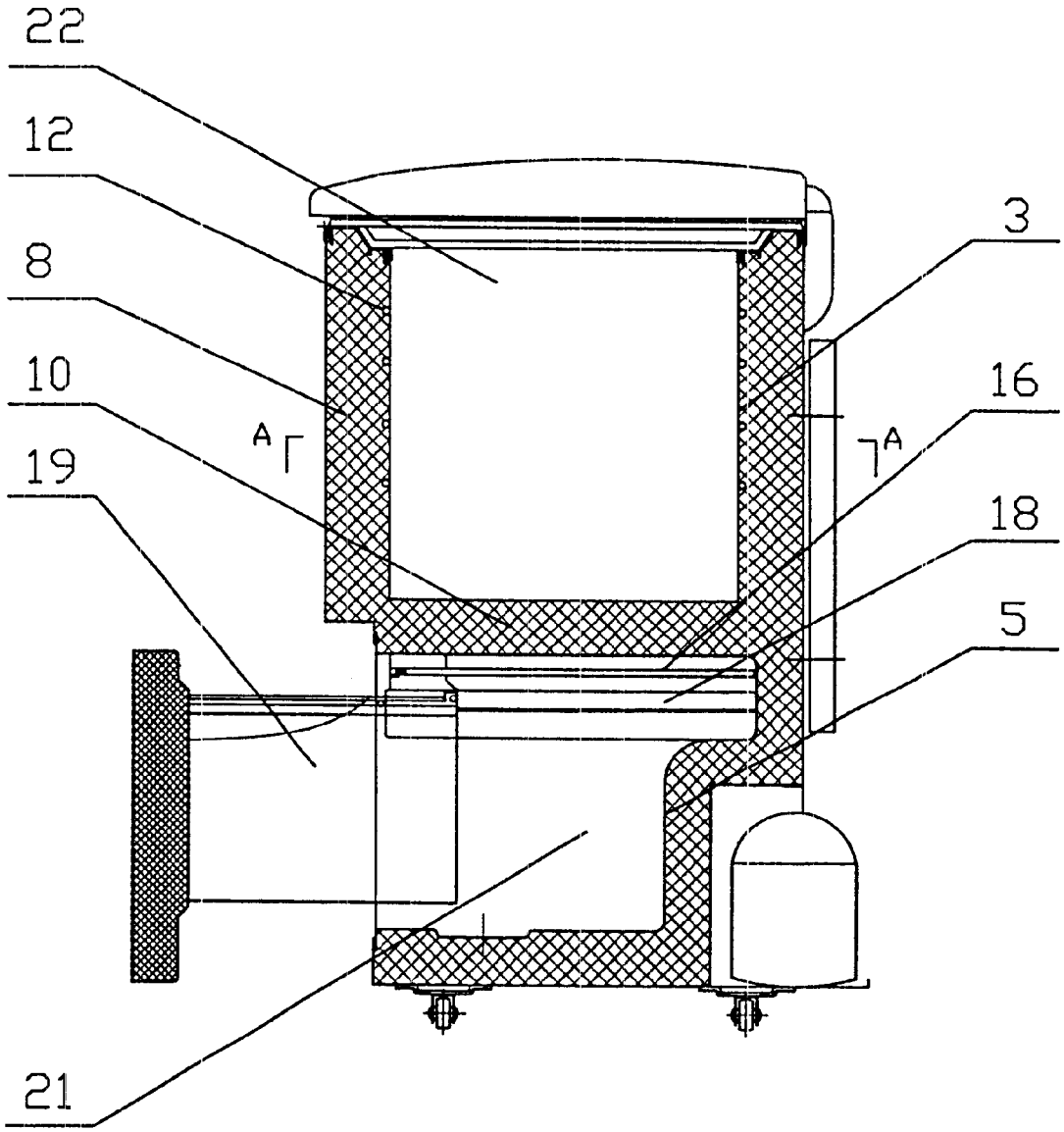
FIG. 2 is a longitudinal sectional view of the freezer shown in FIG. 1 with the top cover, condenser and the compressor not shown in cross-sectional view.

Referring to FIGS. 1 and 2, there shows an embodiment of a horizontal freezer with drawer(s), the freezer is generally referred to numeral 1 and comprises a housing 8 Including an upper freezing chamber 22 and a lower freezing chamber 21, the upper freezing chamber 22 and lower freezing chamber 21 are separated by a plate 10. The upper freezing chamber 22 is provided with a top entrance and the lower freezing chamber is provided with a side entrance. As shown in FIG. 1, an cover 2 is (for example) hinged to the top of the housing 8 for closing the entrance to the upper freezing chamber. The top cover 2 can be made of (for example) foaming material or transparent or semi-transparent materials.

Figure 5:
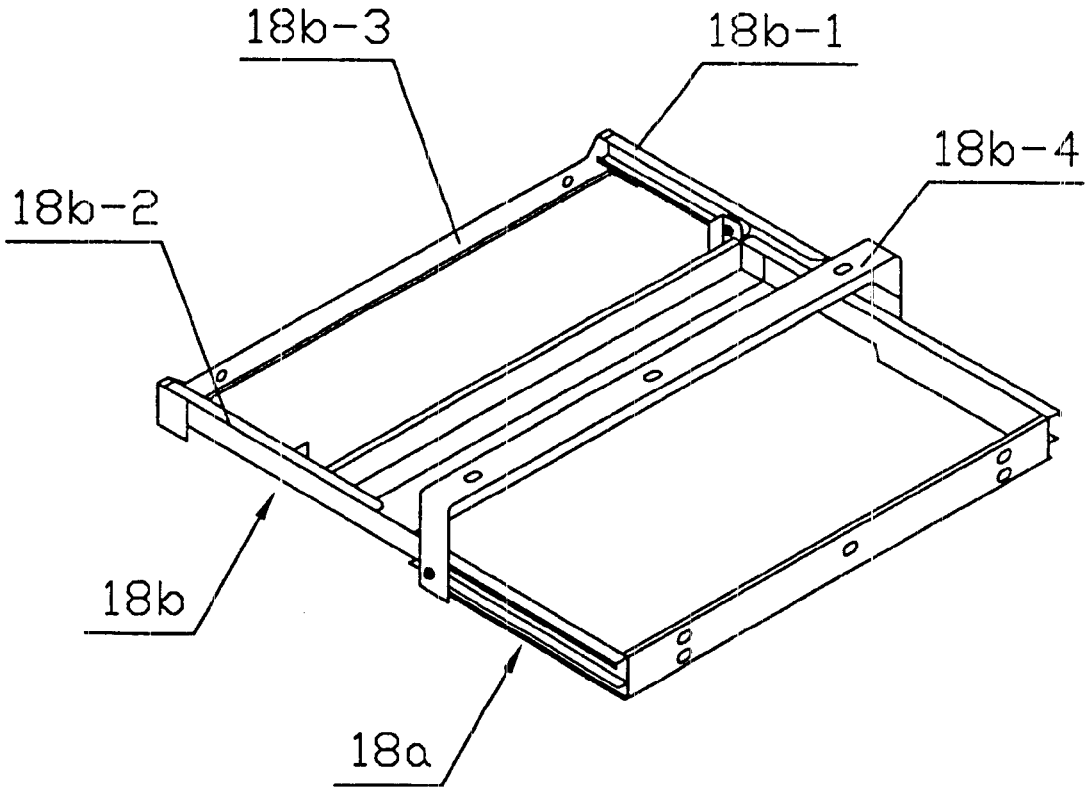
FIG. 5 is a perspective view of the sliding support assembly shown in FIG. 2.

As shown in FIG. 2, a drawer 19 is mounted onto the lower freezing chamber 21 by means of a sliding support assembly 18. Referring to FIG. 5, the sliding support assembly 18 consists of an inner sliding support 18*a* and an outer sliding support 18*b*. As shown, the inner sliding support 18*a* is secured to the drawer 19, and the outer sliding support is secured to the housing 8, the inner sliding support 18*a* is slidably mounted on the outer sliding support 18*b* by a pair of guiding rail 18*b*-1 and 18*b*-2. The outer sliding support 18*b* defines a frame structure and includes a pair of longitudinally extending rail 18*b*-1 and 18*b*-2 and a front crossing bar 18*b*-4 and a rear crossing bar 18*b*-3 connected therebetween, with the front crossing bar 18*b*-4 secured to the plate 10 and the rear crossing bar 18*b*-3 secured to the internal shell 5 in the lower freezing chamber 21.

Figure 3:
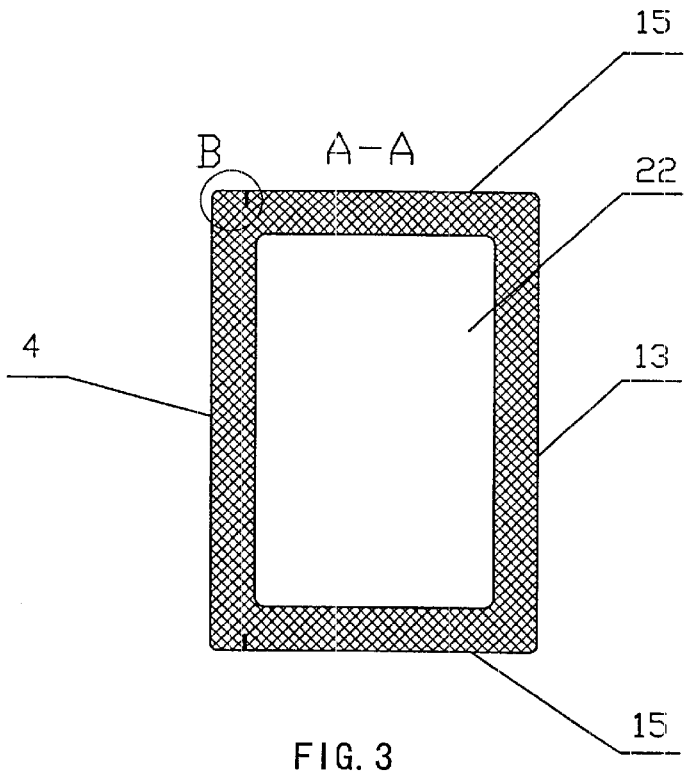
FIG. 3 is a cross-sectional view taken along the line A—A in FIG. 1.
Figure 4:
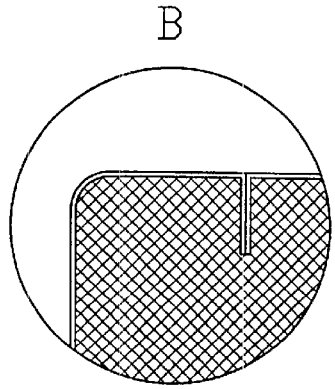
FIG. 4 is an enlarged view of the B area in FIG. 3.

The housing 8 substantially consists of external shell and internal shell and filling material therebetween, the external shell comprising the upper front panel 4, the two opposite side panel 15 and back panel 13 with the upper front panel 4 connected to the two opposite side panels 15 by such as welding (as shown by a weld seam in FIG. 4) or lapping, referring to B area in FIG. 3 and its enlarged view in FIG. 4. The front surface of the upper front panel 4 is flushed with the front surface of the front panel 6 of the drawer. Also, the front panel 6 can be made of transparent or semi-transparent or non-transparent materials.

Figure 6:
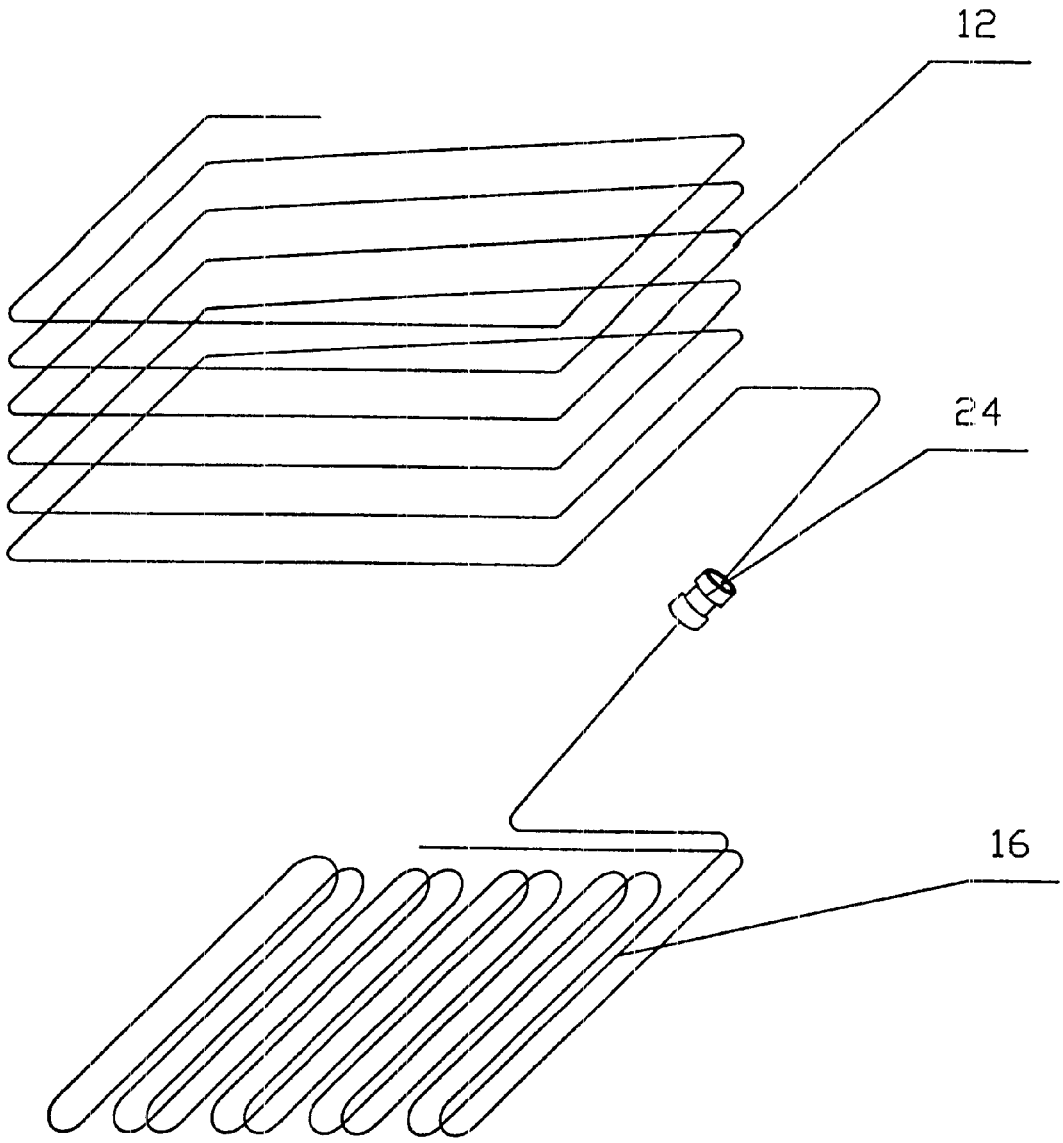
FIG. 6 shows schematically the structure of the evaporator used in the invention.

FIG. 2 also illustrates an evaporator 12 which comprises an upper section 12 provided in upper freezing chamber 22 between external shell and internal shell 3 and lower section 16 in the lower freezing chamber 21. The upper section of the evaporator is wound and placed into the outer wall of the internal shell 3 before injecting foaming agent, and the lower section of the evaporator is exposed in the lower freezing chamber 21. As shown in FIG. 6 detailly, the upper section 12 is a coiled pipe, and the lower section 16 is a planar-wound pipe as known in the art, these two sections is connected each other by a connector in the lower freezing chamber 21.

While an illustrative embodiment of the invention has been described with reference to drawings, it should be understood that any freezing chamber of the freezer herein does not mean that the temperature is certainly below the freezing temperature, and one or all of the chambers can be transformed into cool chambers having a temperature above freezing point by properly modifying the position of the evaporator, In this case, the freezer here so called is, as matter of fact, a kind of refrigerator or cool box. In addition, the freezer can have more than one drawer. Hence, the invention is not limited by said embodiment and it is obvious that many changes and modifications may be made by one of ordinary skilled in the art without departing from the spirit and scope of the invention.

What is claimed is:

1. A horizontal freezer, comprising: a housing including an upper freezing chamber and at least one lower freezing chamber, said upper freezing chamber and said lower freezing chamber being separated by a plate, the upper freezing chamber having a top entrance and the lower freezing chamber having a side entrance; a cover connected to the top of said housing for closing the top entrance of said upper chamber; at least one drawer, said drawer being mounted in said lower freezing chamber by means of a sliding support assembly; an evaporator, at least part of which is embedded in said housing, wherein the outer shell of said housing comprises an upper front panel preformed separately, a back panel and two opposite side panels, with the upper front panel connected to said two opposite side panels of the housing.

2. The freezer of claim 1, wherein the height of said upper panel is less than that of said opposite side panels, and the top edge of the upper front panel is aligned with the top edge of the two opposite side panels during assembling.

3. The freezer of claim 1, wherein said upper front panel is connected to said two opposite side panels by welding.

4. The freezer of claim 1, wherein said upper front panel is connected to the two opposite side panels by lapping.

5. The freezer of claim 1, wherein said evaporator includes a coiled pipe section and a planar-wound pipe section connected each other, with the coiled pipe section embedded in the wall of said housing and said planar-wound pipe section exposed in the upper part of said lower freezing chamber.

6. The freezer of claim 5, wherein said coiled pipe section and planar-wound pipe section are connected to each other in said lower freezing chamber.

7. The freezer of claim 5, wherein said coiled pipe section and planar-wound pipe section are connected to each other by a connector.

8. A horizontal freezer, comprising: a housing including an upper freezing chamber and at least one lower freezing chamber, said upper freezing chamber and said lower freezing chamber being separated by a plate, the upper freezing chamber having a top entrance and the lower freezing chamber having a side entrance and an internal shell; a cover connected to the top of said housing for closing the top entrance of said upper freezing chamber; at least one drawer, said drawer being mounted in said lower freezing chamber by means of a sliding support assembly; an evaporator, at least part of which is embedded in said housing, wherein said sliding support assembly includes an inner sliding support and an outer sliding support, said outer sliding support having two guiding rails extending longitudinally along the two opposite sides of the internal shell, a front crossing bar and a rear crossing bar connected therebetween, with the front crossing bar secured to said plate.

9. The freezer of claim 8, wherein said evaporator includes a coiled pipe section and a planar-wound pipe section connected each other, with said coiled pipe section embedded in the wall of said housing and the planar-wound pipe section exposed in the upper part of said lower freezing chamber.

10. The freezer of claim 9, wherein said coiled pipe section and planar-wound pipe section are connected to each other in said lower freezing chamber.

11. The freezer of claim 9, wherein said coiled pipe section and planar-wound pipe section are connected to each other by a connector.

12. The freezer of claim 10, wherein said coiled pipe section and planar-wound pipe section are connected to each other by a connector.

13. The freezer of claim 8, wherein said rear crossing bar is secured to the rear wall of the internal shell of said lower freezing chamber of the housing.

14. A horizontal freezer, comprising a housing including an upper freezing chamber and at least one lower freezing chamber, said upper freezing chamber and said lower freezing chamber being separated by a plate, the upper freezing chamber having a top entrance and the lower freezing chamber having a side entrance and an internal shell; a cover connected to the top of said housing for closing the top entrance of said upper freezing chamber; at least one drawer, said drawer being mounted in said lower freezing chamber by means of a sliding support assembly; an evaporator, at least part of which is embedded in said housing, wherein the housing has an outer shell and the outer shell of said housing comprises an upper front panel pre-formed separately, a back panel and two opposite side panels, with the upper front panel connected to said two opposite side panels of the housing; said sliding support assembly includes an inner sliding support and an outer sliding support, said outer sliding support having two guiding rails extending longitudinally along the opposite sides of the internal shell, a front crossing bar and a rear crossing bar connected therebetween, with the front crossing bar secured to said plate.

15. The freezer of claim 14, wherein the height of said upper panel is less than that of said opposite panels and the top edge of said upper front panel is aligned with the top edge of the two opposite side panels during assembling.

* * * * *